US005660035A

United States Patent [19]

Musha et al.

[11] Patent Number: 5,660,035

[45] Date of Patent: Aug. 26, 1997

[54] SPINNING METHOD AND SPINNING FRAME

[75] Inventors: Toshimitsu Musha, 13-17, Minami-Tsukushino 2-chome, Machida-shi, Tokyo; Yuichi Yanai, Okazaki; Kazuyoshi Muraoka, Osaka; Yuki Niwa; Yasuo Nakano, both of Okazaki, all of Japan

[73] Assignees: Toshimitsu Musha; Nisshinbo Industries Inc., both of Tokyo, Japan

[21] Appl. No.: 384,539

[22] Filed: Feb. 8, 1995

[30] Foreign Application Priority Data

Feb. 14, 1994 [JP] Japan ..... 6-039239
Mar. 18, 1994 [JP] Japan ..... 6-074279

[51] Int. Cl.[6] ..... D01H 7/46; D01H 7/92

[52] U.S. Cl. ..... 57/264; 57/75; 57/315

[58] Field of Search ..... 57/264, 315, 75

[56] References Cited

U.S. PATENT DOCUMENTS

| | | | |
|---|---|---|---|
| 3,868,496 | 2/1975 | Pugh | 235/95 |
| 4,338,945 | 7/1982 | Kosugi et al. | 128/421 |
| 4,588,934 | 5/1986 | Suzuki et al. . | |
| 4,977,737 | 12/1990 | Yamada et al. | 57/264 |
| 5,400,582 | 3/1995 | Hartmeier et al. | 57/264 |

FOREIGN PATENT DOCUMENTS

| | | | |
|---|---|---|---|
| 62-170542 | 7/1987 | Japan . | |
| 63-112739 | 5/1988 | Japan . | |
| 2044301 | 10/1980 | United Kingdom | 57/315 |
| 2071166 | 9/1981 | United Kingdom | 57/315 |

OTHER PUBLICATIONS

"Bioinformation and 1/f Fluctuation", applied Physics, 1985, pp. 429–435. (Which corresponds to partial translation, Physics of the Living State, Ohmasha, 1994).

"Biocontrol and 1/f Fluctuation" Journal of Japan Society of Precision Machinery, 1984, vol. 50 No. 6. (Which corresponds to partial translation, Computer Analysis of cardiovascular signals Chapter 6 1/f fluctuations of the Biological Rhythm, *1/f Fluctuations of the Biological Rhythm*, IOS Press, 1995).

"The World of Fluctuations" by Kodansha Publisher (Which corresponds to partial translation, 1/f–Like fluctuations of Biological Rhythm, Musha, Brain Functions Laboratory, Japan) Chapter 6.

"Seitai Shingo, Chapter 10, Biological Rhythm", Chapter 10, with a translation of section 2–4 in Chapter 10. (partial translation of Seitai Shingo, section 2–4 in Chapter 10), (Which corresponds to partial translation, Biological Signals—Actual Measurement and Analysis, Corona Publishing Co., Ltd.).

*Primary Examiner*—William Stryjewski
*Attorney, Agent, or Firm*—Nikaido, Marmelstein, Murray & Oram LLP

[57] ABSTRACT

A spinning method and a spinning frame are provided that yields spun yarn, with the comfortable feel of a hand-spun yarn, on an industrial scale. In spinning frame 1, rovings 11 are drafted with signals derived from a numerical sequence of having a 1/f fluctuation or signals derived from a melody or other sound having a 1/f fluctuation to yield a spun yarn 13 in which the diameter varies with said 1/f fluctuation, thus providing a natural, comfortable feel.

22 Claims, 4 Drawing Sheets

SPINNING METHOD AND SPINNING FRAME

FIELD OF INVENTION

This invention relates to yarn spinning utilizing 1/f Fluctuations.

BACKGROUND OF THE INVENTION

The yarn market has heretofore been looking for a high-quality, machine-spun yarn, having the feel of a natural irregularity of coarseness and fineness, thereby providing the texture and appearance of hand-spun yarn. Yarns having this irregularity in texture have been the subject of various studies.

The publication of Japanese Unexamined Patent 62-170542 discloses a spun yarn in which coarse yarn portions and fine yarn portions are mixed at random. In Japanese Unexamined Patent 62-170542, the front roller of a roller-draft type spinning frame is coupled directly to a servo motor whose speed can be freely varied by a DC voltage signal. A computer output controls the rotation of the front roller to vary it appropriately, causing the draft factor to change throughout spinning, thereby producing a yarn of random thickness.

In addition, the publication of Japanese Unexamined Patent 62-112739 discloses a spun yarn obtained by independently driving the middle roller of the draft rollers in a ring spinning frame, using a variable-speed motor, and increasing its speed at random time intervals.

Conventional machine spinning does produce a yarn with a natural, irregular feel by varying the yarn diameter at random, but this randomness produces an artificial texture with very little of the natural feel of a hand-spun yarn and the result is that it is not very comfortable for the wearer.

SUMMARY OF THE INVENTION

To resolve these problems, this invention provides a spinning method and a spinning frame wherein rovings are drafted with a degree of attenuation that varies with a 1/f fluctuation, and then applying a twist to the fiber bundle formed from the drafted rovings.

The present inventor was the first in the world to discover that a 1/f fluctuation would impart a particularly comfortable feel to humans. The results were published in a paper entitled "Bioinformation and 1/f Fluctuation", Applied Physics, 1985, p.p 427–435, and another paper entitled "Biocontrol and 1/f Fluctuation", Journal of Japan. Soc. of Precision Machinery, 1984, Vol. 50, No. 6. The abstract of these papers read as follows:

> The 1/f fluctuation provides a comfortable feeling to humans; the reason being that the variations in the basic rhythm of the human body have a 1/f spectrum. From another perspective, the human body eventually tires of a constant stimulation from the same source, but conversely, the body feels uncomfortable if the stimulations were to change too suddenly; therefore a 1/f fluctuation is a fluctuation of the right proportion between these two extremes.

In addition, an excerpt from "The World of Fluctuations" by Brubachs, published by Kodansha Publisher, 1980, reads as follows:

> For example, the rhythms exhibited by the human body such as heart beats, hand-clapping to music, impulse-release period of neurons, and α-rhythms observed in the brain, are all basically 1/f fluctuations, and it has been shown experimentally that if a body is stimulated by a fluctuation like these biorhythmic 1/f fluctuations, it would feel comfortable.

Fluctuations (variations) exist in various forms throughout nature, but the murmur of a brook, a breath of wind, and other phenomena that impart a comfortable feeling to humans have a 1/f fluctuation, while typhoons and other strong winds that impart uneasiness do not have a 1/f fluctuation.

The objective of this invention is to make a yarn that creates a natural feeling of comfort to human beings. Another objective of this invention is to provide a yarn in which the diameter does not vary randomly, rather the variations have a correlation; specifically, a 1/f fluctuation. Another objective of this invention is to provide a yarn in which the 1/f fluctuation corresponds to and expresses a melody or musical sound.

Another objective of this invention is to provide a method to spin yarn having a natural, irregular feel, on an industrial-scale.

In this invention, "1/f fluctuation" is defined as a power spectrum, with a frequency component f, and proportional to $1/f^k$, where k is approximately 1.

DETAILED DESCRIPTION OF THE DRAWINGS AND OF THE PREFERRED EMBODIMENT

The above and other objects and the attendant advantages of the present invention will become readily apparent by reference to the following detailed description when considered in conjunction with the accompanying drawings wherein:

The technique for spinning yarn involves, firstly, blending a mass of short fibers, for example, raw cotton, and then aligning the fibers in a single direction. A number of the fibers so aligned are bundled into cord-like slivers and then drafted. These operations are repeated, after which a very slight twist is imparted to the rovings 11. Next, the rovings are further drafted by a spinning frame 1, after which a twist is imparted to yield the spun yarn 13. Natural fibers (such as cotton, hemp, flax, etc.), regenerated cellulose fibers (such as rayon, cuprammonium rayon, etc.), semi-synthetic fibers (such as acetate, etc.), synthetic fibers (such as polyester, etc.), and blends of these fibers can be used for rovings 11.

This invention concentrates on the drafting process when spinning these rovings 11 into yarn 13. Drafting with a 1/f fluctuation ultimately causes the thickness of yarn 13 to vary with a 1/f fluctuation. As a result, the thickness of yarn 13 will vary with a correlation of a 1/f fluctuation, making it possible to manufacture large quantities, using mechanical equipment, a yarn 13 having a feeling similar to yarn spun manually.

1. Spinning Frame

Figure 1:
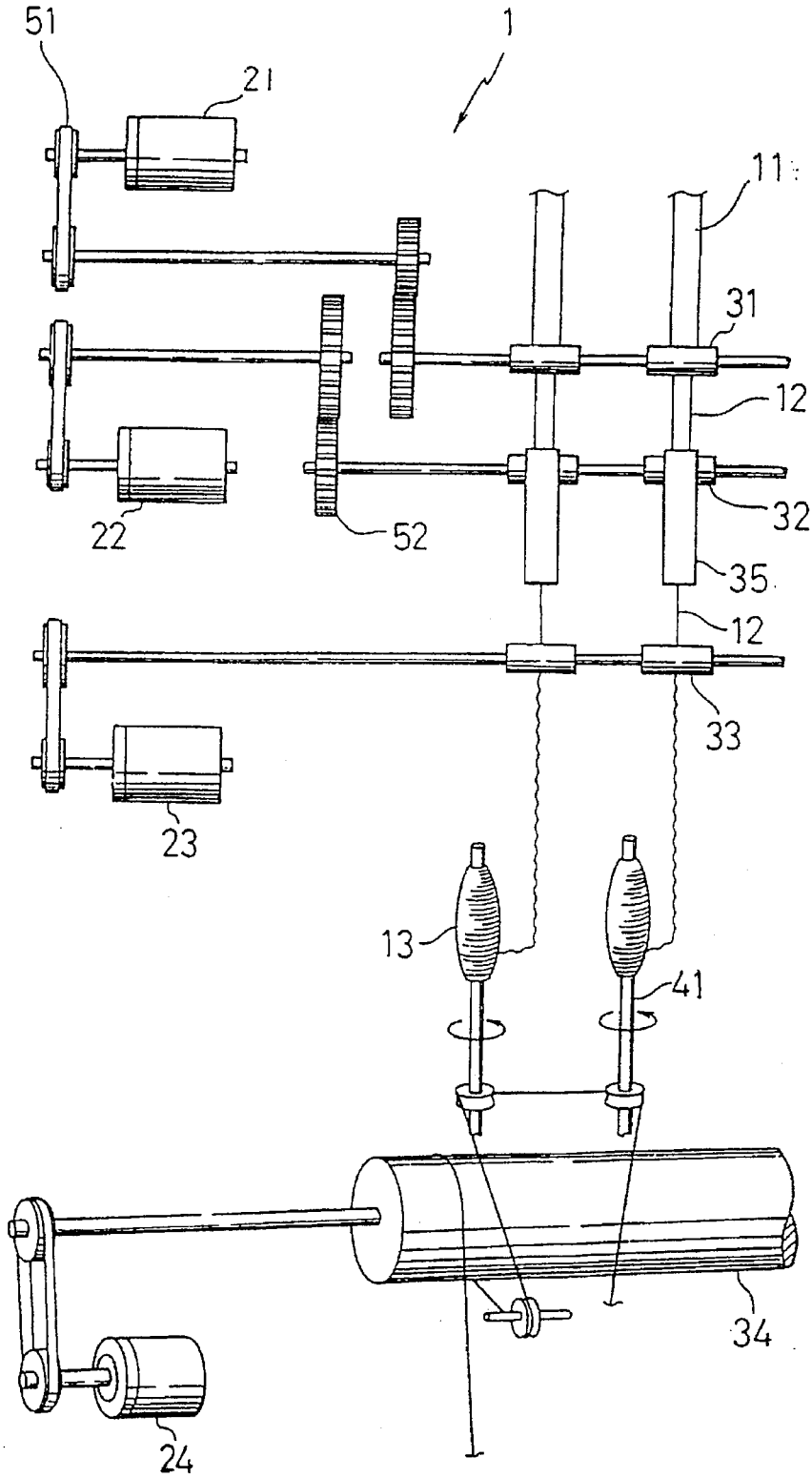
FIG. 1 shows an overview diagram of the principal components of a spinning frame.

The spinning frame 1 is a device to draft rovings 11 and, by imparting twist, spin it into yarn 13. An example of a spinning frame 1 that embodies this invention as shown in the simplified diagram in FIG. 1, is provided with a plural number of motors, for example, a back motor 21, an apron motor 22, a front motor 23 and a spindle motor 24, etc., each of which can be independently controlled. The back motor 21 is used to drive back roller 31. For example, the rotational speed of back roller 31 can be determined by imparting a prescribed rotational speed to back roller 31 via belt 51 and gears 52, and adjusting the size and number of gears 52. Also, the rotational speed of the back rollers 31 can be adjusted arbitrarily by controlling back motor 21. In a similar manner, apron motor 22 and front motor 23 can be independently controlled, and the rotational speed of apron roller 32 and front roller 33 can be adjusted arbitrarily. In this case, too, the rotational speed of apron roller 32 and front roller 33 can be adjusted using belt 51 and gears 52. Also, an arbitrary rotational speed can be imparted to spindle 41 by rotating tin roller 34 using spindle motor 24. These motors can also be used in common where necessary, and the rotational speed of the rollers can be adjusted using converters such as belt 51 and/or gear 52, etc.

2. Back, Apron and Front Rollers

Back roller 31 has a prescribed rotational speed, and pinches rovings 11. The drawing speed of rovings 11 is determined by the diameter and rotational speed of back roller 31. In a similar manner, the apron roller 32 draws out the fiber bundle 12 fed from the back roller 31. A rubber apron 35 is arranged so that it can rotate on the periphery of apron roller 32, and by applying pressure to fiber bundle 12 over a large surface area and holding fiber bundle 12 stable, draws it out. By adopting a drawing speed for apron roller 32 larger than the drawing speed of back roller 31, rovings 11 are drafted in a ratio of, for example, 1.2 to 2. That is to say, by drafting rovings 11 between back roller 31 and apron roller 32, the fibers of rovings 11 slide against each other and are formed into a fiber bundle finer than rovings 11, being made, for example, 1.2 to 2 times longer.

In a similar manner, front roller 33 also draws out fiber bundle 12 fed from apron roller 32. Its drawing speed is set to be greater than the drawing speed of apron roller 32. For example, by setting the drawing speed to be 20 times faster than that of apron roller 32, drafting will form a fiber bundle 12 that is 20 times longer than the original. That is, the diameter of fiber bundle 12 will become thinner. Over the entire spinning frame, by the time rovings 11 are drawn out from back roller 31 and fiber bundle 12 is brought out from front roller 33, the degree of attenuation would be 30 to 40-fold.

3. Spindles

The rotation of spindle 41 imparts a twist to fiber bundle 12 fed from front roller 33 which is then wound as yarn 13 onto bobbins. In reality, the degree of twist is set for the yarn to be able to withstand subsequent processes, generally, weaving, knitting, etc., and to affect the hand of finished woven fabrics, knitted goods, etc. The degree of twist can be expressed by a twist coefficient as shown in Equation 1:

$$K = \frac{T}{\sqrt{Ne}} \tag{1}$$

where,

K is the twist coefficient,

T is the twist count, and Ne is the yarn count.

For yarns of the same yarn count, the twist count increases as the twist coefficient increases, forming yarn with a hard hand, and the twist count decreases as the twist coefficient decreases, forming a bulky yarn with soft hand.

In general, the twist coefficient will be 2.5 to 4.5. To obtain yarns of the same hand, but with a different yarn count, the twist coefficient is set to be constant, and the twist count is set to correspond to the yarn count. The twist is determined by the length of the fiber bundle 12 fed from front roller 33 and by the number of twists imparted over the length; therefore, the twist can be modified by keeping either parameter constant and varying the other. To increase the twist at the same yarn count, the feed from front roller 33 can be kept constant while increasing the rotation of spindle 41; or the rotation of spindle 41 can be kept constant while reducing all feed from back roller 31, apron roller 32, and front roller 33. The same result will be achieved in either case.

4. Imparting a "1/f" Fluctuation to Yarn

To impart a 1/f fluctuation to yarn 13, drafting of fiber bundle 12 can be varied by controlling the back motor 21, the apron motor 22, the front motor 23, and the spindle motor 24. For example, the speed at which fiber bundle 12 is taken up by the apron roller 32 can be kept constant, and the speed at which the fiber bundle 12 is taken up by the front roller 33 can be varied with a 1/f fluctuation, wherein the diameter of the drafted fiber bundle 12 will vary from thick to thin with a 1/f fluctuation. The take-up speed of this front roller 33 can be adjusted by controlling the rotational speed of the front motor 23. Accordingly, in order to impart a 1/f fluctuation to the diameter of yarn 13, a 1/f fluctuation signal is applied to control the rotation of front motor 23, wherein drafting between the apron roller 32 and the front roller 33 will cause the diameter of yarn 13 to vary. Alternatively, rather than controlling the front motor 23, the apron motor 22 can be controlled, or both motors can be controlled concurrently.

Figure 2:
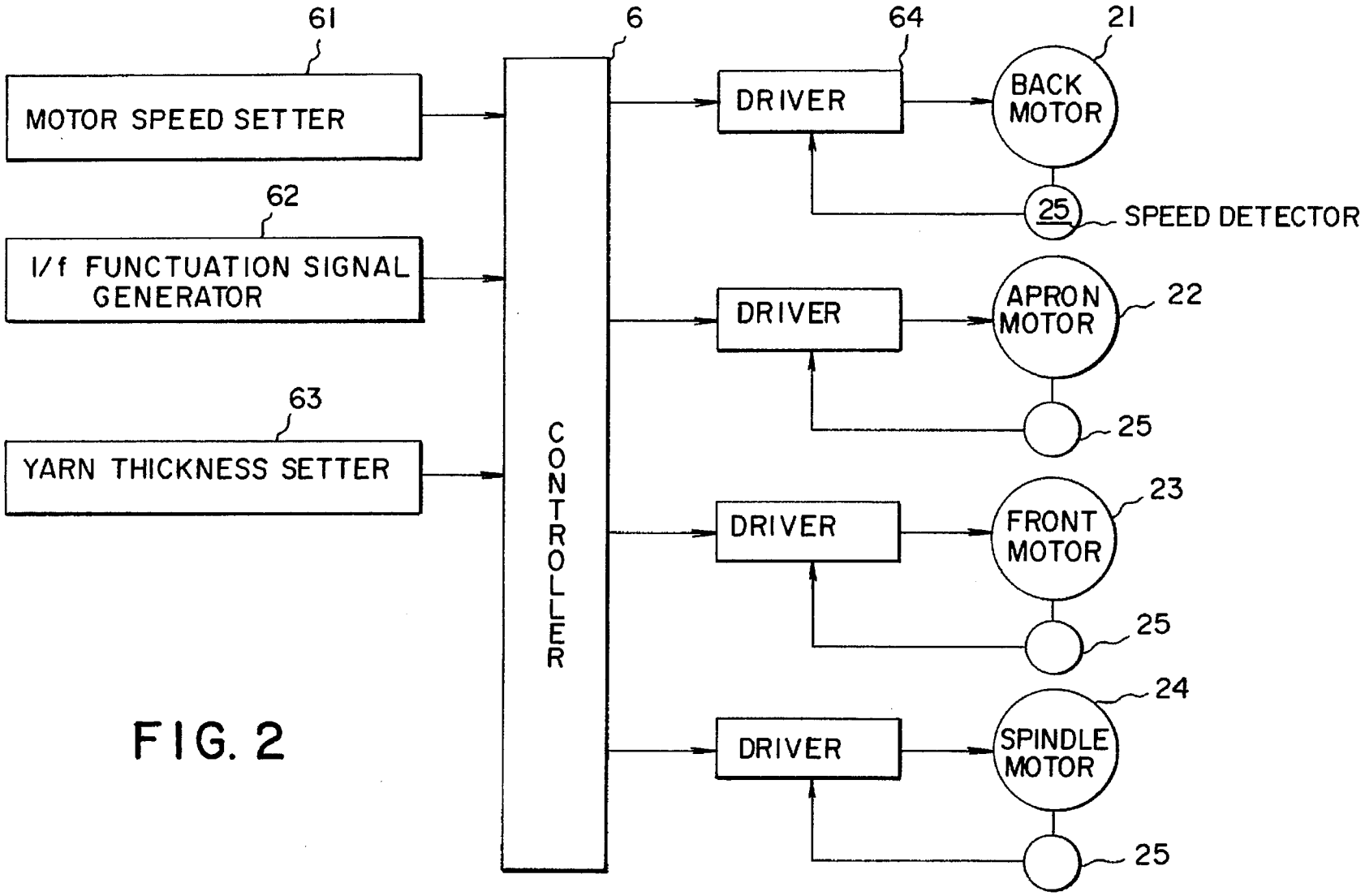
FIG. 2 is a block diagram of the drive system for the spinning frame motors.

FIG. 2 is a block diagram to illustrate the motor controls. Signals from back-, apron-, front-, and spindle-motor speed setter 61, 1/f-fluctuation signal generator 62, and yarn thickness setter 63, are processed by controller 6, and the controller 6 controls motors 21 to 24 via drivers 64. Each motor 21 to 24 supplies feedback via speed detectors 25, allowing their rotational speed to be controlled. Motor speed setters 61 set the speed of each motor to a prescribed value. By imparting a 1/f fluctuation signal from the 1/f-fluctuation signal generator 62 based on these prescribed speed values, a 1/f-fluctuation can be imparted to the rotational speed of the motors. In addition, the "yarn thickness setter" 63 can be set to vary the rotational speed of each motor, thereby setting the thickness of the yarn to prescribed values, wherein a yarn 13 with a 1/f fluctuation based on the set thicknesses, will be spun.

5. 1/f Fluctuation Signal

The 1/f fluctuation signal is determined from $Y_1, Y_2, Y_3, \ldots$ formed by multiplying n coefficients, $a_1, a_2, a_3, \ldots a_n$, on numbers, $X_1, X_2, X_3, \ldots$ Generally, $Y_j$ can be expressed by Equation 2. Here, the sequence of numerical values forming $Y_1, Y_2, Y_3, \ldots$ has a 1/f spectrum. (For further details, refer to Seitai shingou [Biological Signaling], Chapter 10, "Biological Rhythms and Fluctuations," published by Corona Publishers, Ltd.)

$$y_j = x_j + \left(\frac{1}{2}\right) x_{j-1} + \left(\frac{1*3}{2^2*2!}\right) x_{j-2} + \left(\frac{1*3*5}{2^3*3!}\right) x_{j-3} + \ldots \left(\frac{1*3*5*\ldots*(2n-1)}{2^{n-1}*(n-1)!}\right) x_{j-n+1} \tag{2}$$

6. 1/f Fluctuation Signal Generator

In the 1/f-fluctuation signal generator 62 shown in FIG. 2, step 1 generates a sequence of random numbers using, for example, a computer. In step 2, this sequence of random numbers is stored in a storage device, where a certain number, n, of coefficients, a, are successively multiplied on the random numbers, and then a sequence of numerical values, Y, is obtained by a linear transformation. An example of a 1/f fluctuation obtained in this manner is shown below.

Sequence of numerical values={17, 12, 15, 15, 12, 14, 12, 8, 11, 12, 9, 9, 11, 7, 5, 2, 3, 0, 6, 7, 7, 8, 6, 3, 3, 6, 6, 3, 2, 4, 2, 4, 2, 0, 5, 6, 7, 7, 5, 7, 9, 4, 1, 4, 8, 7, 5, 4, 6, 2, 0, 6, 3, 7, 8, 10, 10, 5, 5, 8, 9, 7, 11, 5, 7, 8, 10, 6, 10, 9, 10, 10, 8, 11, 13, 10, 8, 6, 7, 4, 9, 7, 8, 7, 8, 3, 5, 7, 10, 11, 8, 5, 7, 6, 3, 8, 11, 10, 12, 9, 6, 11, 12, 13, 11, 10, 6, 6, 9, 7, 6, 2, 7, 9, 4, 1, 6, 8, 11, 9, 12, 12, 11, 7, 11, 6, 3, 5, 6, 9, 11, 6, 10, 6, 5, 3, 4, 9, 7, 7, 3, 4, 5, 3, 1, 1, 2, 6, 8, 11, 8, 11, 14, 14, 10, 9, 8, 7, 7, 8, 10, 5, 6, 7, 3, 5, 7, 10, 7, 9, 11, 12, 11, 9, 10, 12, 15, 12, 11, 13, 13, 13, 15, 16, 18, 20, 17, 17, 12, 13, 16, 12, 15, 11, 12, 16, 15, 12, 14, 13, . . . } (3)

This numerical sequence has a 1/f spectrum, therefore it is converted into an electrical signal as a 1/f fluctuation signal and outputted to the motor control signal. For example, large values in the numerical sequence can be set to correspond to a high electric potential to increase the speed of the motors, thereby creating a longer draft. This numerical sequence has a 1/f spectrum, and thus the numerical sequence will be made into an electrical signal and output to the motor control signal as a 1/f fluctuation signal. Other methods can also be employed, such as numerical control to control the rotational frequency of the motors using values from the numerical sequence. And if, for example, the inertia of the motors and other components of the control system of spinning frame 1 is large, drafting can also be performed by reducing the level of the 1/f fluctuation control signal as necessary.

7. Twist Control

Spindle 41 applies a twist to fiber bundle 12 fed from front roller 33, forming yarn 13 of suitable strength In applying a twist using said spindle to a fiber bundle 12 of uniform thickness, the strength of the twist can be controlled to have a 1/f fluctuation by applying a 1/f fluctuation signal to the rotational speed of spindle motor 24; or by keeping the rotation of spindle 41 constant and keeping the rotational frequencies of the back motor 21, the apron motor 22, and the front motor 23 at a constant ratio, and then applying the same 1/f fluctuation signal concurrently to the three motors.

On the other hand, if fiber bundle 12 is drafted with a 1/f fluctuation, the rotation of spindle 41 can be controlled to apply a stronger twist to sections of yarn of thin diameter and a weaker twist to sections of yarn of thick diameter, to provide an uniform twist coefficient over the length of the yarn 13. In addition, since the apparent thickness of the yarn varies as a function of the degree of twist, a 1/f fluctuation can be applied that will take this variation into account. In this case, both the drafting motors and spindle 41 motor are controlled to impart a 1/f fluctuation over the entire drafting and twisting process.

8. Creating a Melody Having a 1/f-Fluctuation

Figure 3:
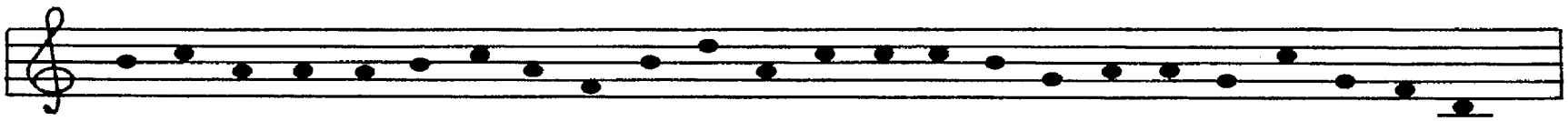
FIG. 3 shows a portion of a melody with a 1/f fluctuation.

To create a melody using Equation 2 for a sequence of numerical values, Y, having a 1/f sequence, first, the scale and the range (lowest frequency fL and highest frequency fU) are determined. A 1/f sequence Y is derived, and a linear transformation is performed so that the upper and lower limits become the lowest frequency fL and highest frequency fU respectively. The values of the sequence Y so derived are regarded as acoustic frequencies, and are substituted for the musical scale they most closely approximate. In other words, they are arranged, for example, as quarter notes, between or on the lines of a staff on music paper. FIG. 3 shows a portion of a melody derived using this method. The pitch and duration of the notes of the arranged melody are set to the corresponding rotational speed of the motor and the duration of that speed, thereby controlling the motor, and upon drafting the fiber bundle, the melody is expressed in the variations in the diameter of the yarn.

9. Generating Control Signals from Sounds Having a 1/f-Fluctuation

Acoustic frequency fluctuations of the sound of the murmur of a brook, the music of J. S. Bach, and the music of W. A. Mozart have a 1/f fluctuation. Accordingly, a recording or live performance of these sounds is sampled at a constant interval, for example, every 25 ms, the mean acoustic frequency is given by the number of zero-crossing of the sound wave form. The sequence of average frequencies so obtained is mapped as musical notes, which can then be used as signals required for motor control. The relationship between the music and a 1/f fluctuation is described in Yuragi no Sekai [The World of Fluctuation] published by Kodansha Publisher in 1980, and Mugen, kaosu, yuragi [Infinity, Chaos and Fluctuation] published by Baifukan in 1985.

10. Spun Yarn

Figure 4:
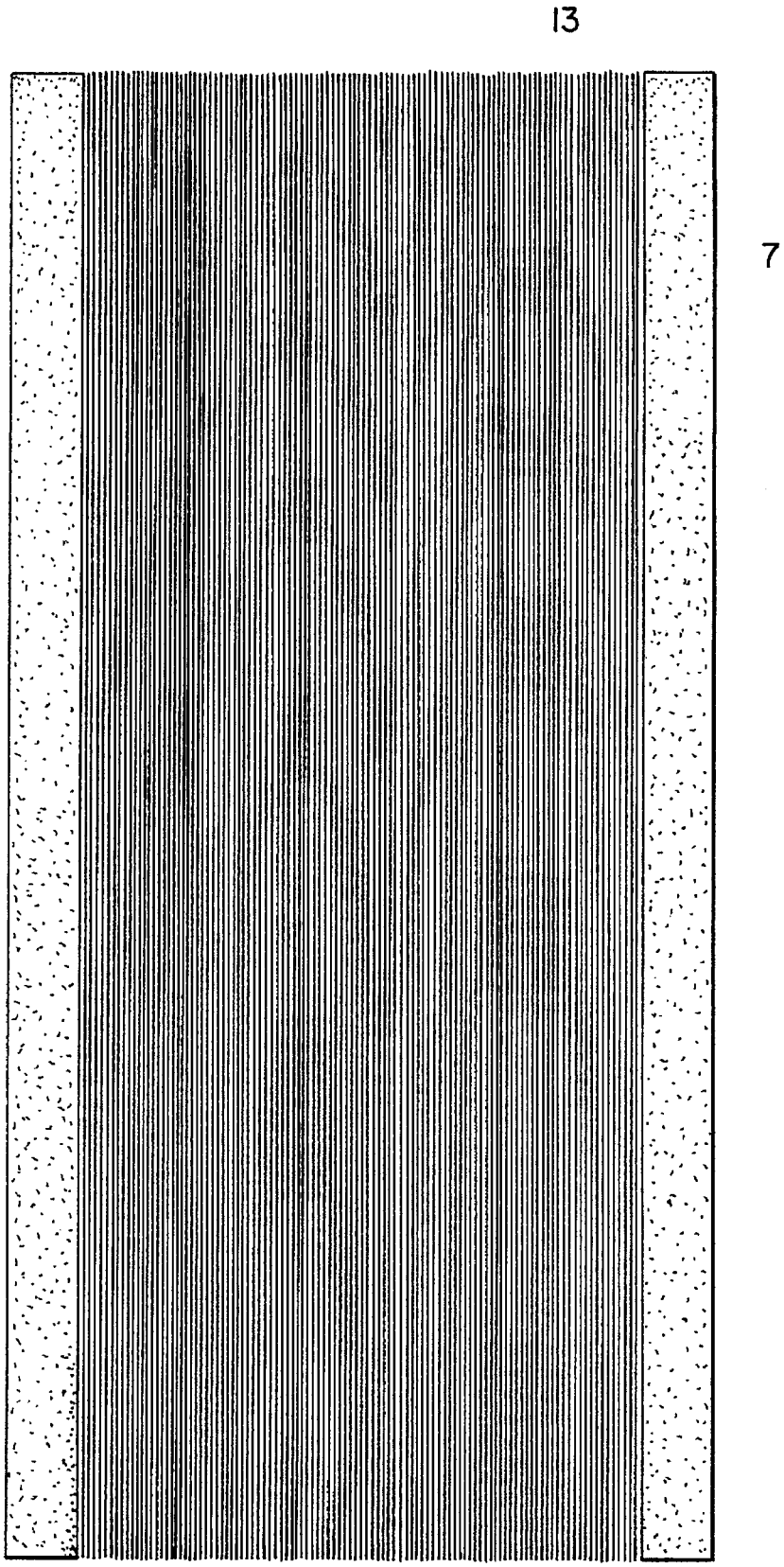
FIG. 4 shows a yarn drafted using the melody in FIG. 3.

A linear sequence Y, a melody derived from a linear sequence Y, or a melody derived from recorded signals of a live musical performance, or the murmur of a brook, is inputted into a 1/f fluctuation signal generator to obtain a 1/f fluctuation signal. The base speed of the motors and the thickness of the yarn are set using the motor speed setter 61 and "yarn thickness setter" 63 respectively. In one example, to produce a spun yarn, the melody of FIG. 3 was input into the 1/f fluctuation signal generator, and the 1/f fluctuation signal so obtained was used to control the front motor to spin a yarn with a 1/f fluctuation. FIG. 4 shows the yarn obtained in this way wound on an evenness defects test panel 7. For motor control, the duration of one note in the melody was set to be equivalent to 1 meter of yarn, the "la" note at 440 Hz was set to be equivalent to a thickness of yarn count 30, and the difference between each adjacent note on the "do, re, mi, fa, so, la, ti, do" scale was set to be equivalent to a yarn count of 5; under these conditions, the yarn became finer with higher frequencies. In this case, the length of variable thickness of yarn between notes was on the order of several centimeters.

Effectiveness of Invention

This invention is effective (offers advantages) as follows.

The diameter of the yarn does not change randomly, rather the change has a correlation of a 1/f fluctuation, thus imparting to the yarn a feel with the natural irregularity of hand-spun yarn, which provides a special esthetics beauty and comfortable wear.

A 1/f fluctuation can be imparted to the twist of the yarn, thereby varying the texture of the yarn, to again provide comfortable wear.

Yarn with a hand-spun natural irregular feel can be spun on an industrial scale, at low cost.

The amount of twist can be varied as a function of the diameter of the yarn, thereby enabling a uniform twist coefficient over the length of the yarn.

Expressing a 1/f fluctuation as a melody or tone and incorporating that fluctuation into the yarn to vary its diameter can provide a comfortable wear.

It is readily apparent that the above-described has the advantage of wide commercial utility. It should be understood that the specific form of the invention hereinabove described is intended to be representative only, as certain modifications within the scope of these teachings will be apparent to those skilled in the art. Accordingly, reference should be made to the following claims in determining the full scope of the invention.

We claim:

1. A spinning method that spins rovings into yarn comprising:

drafting rovings into yarn with a specific standard thickness, said yarn varying in thickness within a limited range based on a 1/f fluctuation; and applying a twist to a fiber bundle drafted from said rovings.

2. A spinning method as claimed in claim 1, wherein, yarn is spun by applying a strong twist to thin portions of the fiber bundle drafted from said rovings.

3. A spinning method that spins rovings into yarn comprising:

drafting rovings into a fiber bundle; and applying a twist by serial signals having a 1/f fluctuation to said fiber bundle.

4. A spinning frame that spins rovings into yarn, comprising:

a back roller that draws rovings;

an apron roller that draws a fiber bundle fed from said back roller;

a front roller that draws a fiber bundle fed from said apron roller;

a spindle that receives a fiber bundle fed from said front roller; and means for controlling drafting of a fiber bundle between said apron roller and said front roller in which a difference in drawing speed between said apron roller and said front roller has been set to vary with a 1/f fluctuation, and then applying a twist to the fiber bundle using said spindle.

5. A spinning frame as claimed in claim 4, in which a rotational speed of said front roller is variable, a drawing speed of said apron roller is kept constant, and a drawing speed of said front roller is set to vary with a 1/f fluctuation.

6. A spinning frame as claimed in claim 5, in which the spindle applies a strong twist to the thin portions of a fiber bundle drafted between the apron roller and the front roller.

7. A spinning frame as claimed in claim 5 in which a drawing speed of said front roller and the drawing duration is set to correspond to the pitch and duration respectively of the notes of a melody with a 1/f fluctuation, wherein a fiber bundle is drafted between the said apron roller and said front roller.

8. A spinning frame as claimed in claim 5 in which a drawing speed of said front roller is set to correspond to the average frequency of each periodic interval of a sound having a 1/f fluctuation, wherein a fiber bundle is drafted between the said apron roller and said front roller.

9. A spinning frame as claimed in claim 4, in which a rotational speed of said apron roller is variable, a drawing speed of said front roller is kept constant, and a drawing speed of said apron roller is set to vary with a 1/f fluctuation.

10. A spinning frame as claimed in claim 9, in which the spindle applies a strong twist to the thin portions of a fiber bundle drafted between the apron roller and the front roller.

11. A spinning frame as claimed in claim 9 in which a drawing speed of said apron roller and the drawing duration is set to correspond to the pitch and duration respectively of the notes of a melody with a 1/f fluctuation, wherein a fiber bundle is drafted between the said apron roller and said front roller.

12. A spinning frame as claimed in claim 9 in which a drawing speed of said apron roller is set to correspond to the average frequency of each periodic interval of a sound having a 1/f fluctuation, wherein a fiber bundle is drafted between the said apron roller and said front roller.

13. A spinning frame as claimed in claim 4, in which the spindle applies a strong twist to thin portions of a fiber bundle drafted between the apron roller and the front roller.

14. A spinning frame as claimed in claim 4 in which a drawing speed of said front roller and the drawing duration is set to correspond to the pitch and duration respectively of the notes of a melody with a 1/f fluctuation, wherein a fiber bundle is drafted between the said apron roller and said front roller.

15. A spinning frame as claimed in claim 4 in which a drawing speed of said front roller is set to correspond to the average frequency of each periodic interval of a sound having a 1/f fluctuation, wherein a fiber bundle is drafted between the said apron roller and said front roller.

16. A spinning frame as claimed in claim 4 in which a drawing speed of said apron roller and the drawing duration is set to correspond to the pitch and duration respectively of the notes of a melody with a 1/f fluctuation, wherein a fiber bundle is drafted between the said apron roller and said front roller.

17. A spinning frame as claimed in claim 4 in which a drawing speed of said apron roller is set to correspond to the average frequency of each periodic interval of a sound having a 1/f fluctuation, wherein a fiber bundle is drafted between the said apron roller and said front roller.

18. A spinning frame that spins rovings into yarn, comprises:

a back roller that draws said rovings;

an apron roller that draws a fiber bundle fed from said back roller;

a front roller that draws a fiber bundle fed from said apron roller; and a spindle that receives a fiber bundle fed from said front roller, wherein a rotational speed of said spindle, used to apply a twist to the fiber bundle, is set to vary with a 1/f fluctuation.

19. A spinning frame as claimed in claim 18 in which a drawing speed of said front roller and the drawing duration is set to correspond to the pitch and duration respectively of the notes of a melody with a 1/f fluctuation, wherein a fiber bundle is drafted between the said apron roller and said front roller.

20. A spinning frame as claimed in claim 18 in which a drawing speed of said front roller is set to correspond to the average frequency of each periodic interval of a sound having a 1/f fluctuation, wherein a fiber bundle is drafted between the said apron roller and said front roller.

21. A spinning frame as claimed in claim 18 in which a drawing speed of said apron roller and the drawing duration is set to correspond to the pitch and duration respectively of the notes of a melody with a 1/f fluctuation, wherein a fiber bundle is drafted between the said apron roller and said front roller.

22. A spinning frame as claimed in claim 18 in which a drawing speed of said apron roller is set to correspond to the average frequency of each periodic interval of a sound having a 1/f fluctuation, wherein a fiber bundle is drafted between the said apron roller and said front roller.

* * * * *